US010029262B2

(12) United States Patent
Ahlqvist Jeanneret et al.

(10) Patent No.: US 10,029,262 B2
(45) Date of Patent: Jul. 24, 2018

(54) METHOD OF FRAGMENTING AND/OR WEAKENING OF MATERIAL BY MEANS OF HIGH VOLTAGE DISCHARGES

(75) Inventors: Helena Ahlqvist Jeanneret, Bollion (CH); Reinhard Muller-Siebert, Bern (CH); Heiko Feitkenhauer, Hamburg (DE); Alexander Weh, Bern (CH); Fabrice Monti Di Sopra, Thun (CH); Peter Hoppe, Stutensee (DE); Josef Singer, Eggenstein-Leopoldshafen (DE); Harald Giese, Stutensee (DE); Klaus Leber, Karlsdorf-Neuthard (DE)

(73) Assignee: selFrag AG, Kerzers (CH)

( * ) Notice: Subject to any disclaimer, the term of this patent is extended or adjusted under 35 U.S.C. 154(b) by 1038 days.

(21) Appl. No.: 14/348,851

(22) PCT Filed: Oct. 10, 2011 (Under 37 CFR 1.47)

(86) PCT No.: PCT/CH2011/000242

§ 371 (c)(1), (2), (4) Date: Aug. 19, 2014

(87) PCT Pub. No.: WO2013/053066

PCT Pub. Date: Apr. 18, 2013

(65) Prior Publication Data

US 2015/0069153 A1 Mar. 12, 2015

(51) Int. Cl.
*B02C 19/18* (2006.01)
*B02C 25/00* (2006.01)
(Continued)

(52) U.S. Cl.
CPC ..... *B02C 19/18* (2013.01); *B02C 23/06* (2013.01); *B02C 23/12* (2013.01); *B02C 23/22* (2013.01);
(Continued)

(58) Field of Classification Search
CPC ..... B02C 19/18; B02C 23/36; B02C 23/12; B02C 23/22; B02C 23/06; B02C 2019/183
See application file for complete search history.

(56) References Cited

U.S. PATENT DOCUMENTS 4,540,127 A * 9/1985 Andres ..... B02C 19/18 241/1
7,246,761 B2 7/2007 Hoppe et al.
(Continued)

FOREIGN PATENT DOCUMENTS

DE 10302867 B3 4/2004
DE 10346650 A1 5/2005
(Continued)

OTHER PUBLICATIONS

International Search Report in corresponding PCT/CH2011/000242 dated Oct. 2, 2012.
(Continued)

*Primary Examiner* — Faye Francis
(74) *Attorney, Agent, or Firm* — Marshall, Gerstein & Borun LLP

(57) ABSTRACT

A method of fragmenting and/or weakening of material is provided that utilizes high voltage discharges. The material is together with a process liquid introduced into a process area, in which two electrodes face each other at a distance, and is arranged therein in such a manner that the area between the two electrodes is filled with the material and process liquid. Between the two electrodes high voltage discharges are generated for fragmenting or weakening of the material. During the fragmenting or weakening, respectively, of the material, process liquid is discharged from the process area and process liquid is fed into the process area.
(Continued)

The process liquid which is fed has a lower electrical conductivity than the process liquid which is discharged.

51 Claims, 11 Drawing Sheets

(51) Int. Cl.

| | |
|---|---|
| ***B02C 23/06*** | (2006.01) |
| ***B02C 23/12*** | (2006.01) |
| ***B02C 23/22*** | (2006.01) |
| ***B02C 23/36*** | (2006.01) |

(52) U.S. Cl.
CPC ..... *B02C 23/36* (2013.01); *B02C 25/00* (2013.01); *B02C 2019/183* (2013.01)

(56) References Cited

U.S. PATENT DOCUMENTS

| | | | | |
|---|---|---|---|---|
| 7,677,486 | B2 * | 3/2010 | Hoppe | B02C 19/18 241/1 |
| 2007/0187539 | A1 * | 8/2007 | Hoppe | B02C 19/18 241/301 |
| 2008/0283639 | A1 * | 11/2008 | Frey | B02C 19/18 241/20 |

FOREIGN PATENT DOCUMENTS

| | | | |
|---|---|---|---|
| EP | 1243339 | A2 | 9/2002 |
| FR | 1341851 | A | 11/1963 |
| GB | 1284426 | A | 8/1972 |
| GB | 1407859 | A | 9/1975 |
| JP | 46-026574 | | 2/1971 |
| JP | 534668 | | 2/1978 |
| JP | 10-057832 | | 3/1998 |
| JP | 2003320268 | A | 11/2003 |
| JP | 3565170 | B2 | 9/2004 |
| JP | 2007504937 | A | 3/2007 |
| RU | 2347619 | C1 | 2/2009 |
| SU | 697188 | A1 | 11/1979 |
| SU | 874183 | A1 | 10/1981 |
| SU | 888355 | A1 | 11/1991 |
| WO | WO-99/03588 | A1 | 1/1999 |
| WO | WO-2007/093063 | A1 | 8/2007 |

OTHER PUBLICATIONS

Japanese Office Action for Application No. 2014-534902, dated Oct. 19, 2015.

* cited by examiner

METHOD OF FRAGMENTING AND/OR WEAKENING OF MATERIAL BY MEANS OF HIGH VOLTAGE DISCHARGES

TECHNICAL FIELD

The invention concerns methods of fragmenting and/or weakening of material by means of high voltage discharges, a high voltage electrode for a process area for conducting the methods, a process area with such a high voltage electrode for conducting the methods, a process vessel forming such a process area as well as a plant for fragmenting and/or weakening of material by means of high voltage discharges having such a process vessel according to the preambles of the independent claims.

BACKGROUND ART

It is known from prior art to comminute pieces of material, for example of concrete or rock, by means of pulsed high voltage discharges or to weaken them by means of pulsed high voltage discharges, i.e. to produce cracks in them so that in a subsequent mechanical comminution process it is easier to comminute them.

For doing so, the material that is to be fragmented or weakened, respectively, together with a process liquid, for example water, is introduced into a process area, inside which between two electrodes high voltage discharges are generated. In this process, generally two different modes of action are differentiated.

In the so called electrohydraulic acting upon the material that is to be fragmented or weakened, respectively, the discharging path runs exclusively through the process liquid, so that shock waves are produced within the process liquid which act upon the material that is to be fragmented or weakened, respectively. This mode of action however has the disadvantage, that only a small amount of the energy required for generating the high voltage discharges serves for the fragmentation or weakening of the material, respectively. Accordingly, in the electrohydraulic acting mode, for achieving relative modest fragmentation or weakening results, respectively, large amounts of energy are required, the provision of which furthermore is associated with a high expenditure on the equipment side. Furthermore, the fragmentation or weakening of relative hard materials is practically not possible by means of the electrohydraulic mode of action.

In the so called electrodynamic acting mode, the discharging path runs at least partially through the material that is to be fragmented or weakened, respectively, so that inside the material itself a shock wave is generated. With this mode of action, a considerable larger portion of the expended amount of energy can be deployed for the fragmentation or weakening of the material than in the electrohydraulic acting mode, and also considerably harder materials can be fragmented or weakened, respectively.

However, also in the electrodynamic methods known today the energy efficiency and the capability of fragmentation or weakening, respectively, hard and brittle materials cannot be considered as being satisfactory. Also it has shown that in the methods of fragmenting or weakening, respectively, of materials by means of high voltage discharges known today, with some materials, like e.g. concrete, after an initially predominant electrodynamic acting upon the material, relative quickly it comes to a change to a substantially electrohydraulic acting, resulting in the effect that the effectiveness of the fragmentation or weakening process, respectively, decreases rapidly or the high voltage discharges at the worst cause no fragmentation or weakening of the material at all. Due to this phenomenon such methods today are uneconomical or even unsuitable for certain materials.

DISCLOSURE OF THE INVENTION

Hence, it is a general object of the invention to provide methods and devices for the fragmentation or weakening, respectively, of materials by means of high voltage discharges, which do not have the disadvantages of the prior art or at least partially avoid them.

This object is achieved by the subjects of the independent claims.

Accordingly, a first aspect of the invention concerns a method of fragmenting and/or weakening of material, preferably of rock material or ore, by means of high voltage discharges. The term fragmentation means here a comminution of the material, the term weakening (also pre-weakening) means here a generation of internal cracks inside the material, which facilitate a further, in particular mechanical comminution of the material. According to this method, the material that is to be fragmented or weakened, respectively, together with a process liquid is introduced into a process area, in which two electrodes are facing each other at a distance and by doing so form between them a high voltage discharge gap within the process area. The material that is to be fragmented or weakened, respectively, and the process liquid are arranged within the process area in such a way that the area between the two electrodes is filled with material that is to be fragmented or weakened, respectively, and process liquid. Between the two electrodes, high voltage discharges are generated for fragmenting and/or weakening the material which has been introduced into the process area. In doing so, during the fragmenting or weakening, respectively, of the material, process liquid is discharged from the process area and process liquid is fed into the process area, wherein the fed process liquid has a lower electrical conductivity than the discharged process liquid. Preferably, the conductivity of the fed process liquid is in the range between 0.2 micro-Siemens per cm and 5000 micro-Siemens per cm.

It has shown that by this measure the energy efficiency and the capability of comminution of hard and brittle materials of the electrodynamic methods known today can considerably be improved and that in case of problematic materials a chance from an electrodynamic acting mode to an electrohydraulic acting mode can be prevented or at least be slowed down. Furthermore, this measure now makes possible the application of the electrodynamic methods for the comminution or weakening, respectively, of materials for which they have been not suitable before.

Preferably, the discharging and feeding of the process liquid takes place simultaneously, since this makes possible the formation of a flushing flow, by which purposely certain areas of the process area can be flushed.

If in that case the fed and discharged volumes of process liquid are substantially identical, what is also preferred, it becomes possible to prevent a fluctuation in the process liquid level in the process area or to at least keep it within tight limits, which in particular is desirable in continuous methods.

In doing so, the feeding and discharging of process liquid can take place continuously or in intervals, depending on the process management. In case of a continuous feeding and discharging of process liquid, the advantage is arrived at that a continuous flushing flow becomes possible, with a quasistatical conductivity situation in the flushed process area zone. In case the feeding and discharging of the process liquid takes place in intervals, even with the exchange of minor amounts through an intense short-term streaming a sound flushing of certain zones can be realized.

Likewise it is however also envisaged to perform the discharging and feeding of the process liquid shifted time-wise, resulting in the effect that a pronounced fluctuation in the process liquid level in the process area takes place. Depending on the geometric design of the process area, this can have a positive effect on the flushing effect. If in that case the volumes of process liquid which are fed and discharges are substantially identical, which also is preferred, the process liquid level in the process area fluctuates between two stable liquid levels.

As a special case it is also envisaged that first of all the entire process liquid is discharged from the process area and thereafter preferably the same amount of process liquid is fed into the process area, wherein for doing so, advantageously the generating of high voltage discharges between the two electrodes is suspended.

Likewise there are of course also other variants envisaged, in which the feeding or discharging of process liquid takes place continuously and the discharging or feeding takes place in intervals, so that as well it comes to a fluctuation of the process liquid level in the process area, which in case the amounts of process liquid which are fed and discharged per interval are identical again range between two stable liquid levels. Depending on the geometry of the process area and the desired process management this can have positive effects on a mixing of present and newly fed process liquid.

In a further preferred embodiment of the method, the discharged process liquid is subjected to a conditioning step, in which its electrical conductivity is reduced. Thereafter it is completely or partially fed back into the process area. By this it becomes possible to completely or partially re-use the discharged process liquid as process liquid for the fragmentation or weakening process, respectively, in the process area.

In that case, the conditioning of the process liquid preferably takes place by withdrawal of ions, by dilution with process liquid of lower conductivity, by withdrawal of fines, by changing the pH-value of the process liquid and/or by adding of complexing agents. These individual measures are known to the person skilled in the art and therefore do not need to be explained here more into detail.

Further it is of advantage in the two before mentioned embodiments of the method that the process area for forming a process liquid circuit is connected to the inlet and the outlet of a process liquid treatment plant for decreasing the electrical conductivity of the process liquid, and that process liquid is circulated in this circuit. Therein, at a first location of the process area, process liquid is withdrawn from the process area and is fed to the process liquid treatment plant. Inside the process liquid treatment plant, it is then reduced in its electrical conductivity, e.g. by means of the before mentioned measures, and thereafter, at a second location of the process area, is completely or partially fed back into the process area. Such methods have the advantage that the consumption of process liquid can be kept very low and at the same time it is possible to also keep the amounts of waste, which need to be disposed of, very low.

Preferably, in the method according to the invention the feeding of process liquid to the process area takes place in such a way that a purposeful introduction of process liquid into the reaction zone between the two electrodes results. The term reaction zone means her the zone in which typically the high voltage discharges occur. By this it becomes possible to manipulate the fragmentation or weakening process, respectively, even with small amounts of fed process liquid. Often, the quality of the process liquid in the remaining zones of the process area is not important for the process or is of minor importance, respectively, so that an intense flushing of these zones would not provide any benefit and would merely increase the expenditure with regard to the technical installation.

Further it is preferred that the feeding and discharging of process liquid takes places in such a way that the fed process liquid fed flows through the reaction zone between the two electrodes, in particular from top to bottom or from bottom to top or in a direction from the centre of the reaction zone radially outwards. Such a flow pattern has the advantage that old process liquid and the fines contained therein are flushed out of the reaction zone and in the reaction zone substantially freshly fed process liquid is present.

By advantage, the feeding of process liquid into the process area takes place via one of the electrodes or via both electrodes. By this, separate feeding arrangements can be dispensed with.

In that case it is preferred that a feeding of process liquid takes place via one or several feeding openings arranged on the face of the respective electrode, namely by advantage via a central feeding opening and/or via several feeding openings arranged concentrically around the centre of the electrode. This has the advantage that practically necessarily an advantageous feeding of the process liquid in the area of the reaction zone results.

If in that case one or two rod-shaped electrodes are used and the feeding of process liquid takes place via one or several feeding openings arranged at the circumference of the respective electrode, in particular via several feeding openings which are equally distributed over the circumference of the electrode, which is preferred, the advantage is arrived at that a purposeful feeding of the process liquid into the reaction zone becomes possible.

In any case it is of advantage if the feeding of the process liquid to the feeding openings takes place via a central feeding bore hole inside the respective electrode, since by doing so simple designed cost effective electrodes can be employed and furthermore a central longitudinal bore hole in a high voltage electrode has the smallest influence on its current conduction capability in the intended use.

In still a further preferred embodiment of the method, one or two electrodes which are surrounded by an isolator are employed. The feeding of the process liquid takes places via the isolator of one or both electrodes. By this the advantage is arrived at that a feeding near the electrode via low-wear, non-current-carrying components is possible, so that the high voltage electrode as such, which has to be considered a consumable part, can be of simple and thus cost effective design.

In that case it is further preferred that the feeding of process liquid takes place via one or several feeding openings arranged on the face of the respective isolator, namely preferably via several feeding openings which are arranged concentrically around the centre of the electrode at the respective isolator, since in doing so a uniform feeding into the reaction zone is possible.

In further preferred embodiments of the method the feeding of process liquid takes place via an arrangement of feeding orifices or via an annular gap, which surround the respective electrode or its isolator concentrically.

In still a further preferred embodiment of the method, a process area is provided at which the two electrodes are arranged, seen in direction of gravity, above each other and at which the lower electrode is formed at the bottom of the process area. Such process areas have proven especially suitable, since in case of an appropriate design a gravity force driven feeding of the material that is to be fragmented or weakened, respectively, into the reaction zone and also a gravity force driven discharging of the material that has been fragmented or weakened, respectively, out of the reaction zone and out of the process area becomes possible, and thus, separate conveying means for this purpose can be dispensed with.

In that case it is preferred that the feeding of process fluid and/or the discharging of process fluid takes place via one or several discharging openings at the bottom of the process area. This has the advantage that a flushing flow in the area of the bottom can be generated, by means of which fines depositing there can be discharged from the process area. Furthermore, it becomes possible by this to discharge all process liquid present in the process area by gravity forces from the process area.

In another preferred embodiment of the method a process area is provided at which the two electrodes are arranged, seen in direction of gravity, beside each other, wherein preferably both electrodes comprise an isolator and are charged with a potential unequal to ground potential. In this way, substantially horizontal high voltage discharges can be generated between the electrodes, which provides the possibility to charge a material stream, which by means of gravity forces is fed in vertical direction through the process area, with high voltage discharges and thereafter discharge it without deflection out of the reaction zone.

Preferably, for discharging of the process liquid from the process area and for the removal of the fragmented or weakened material, respectively, from the process area different openings are used. By this, a larger freedom with respect to the design of the process area and, if so, to the generation of a flushing flow in certain areas thereof, is arrived at.

Also it is of advantage if the fragmented or weakened material, respectively, is removed via an in particular central opening or via several discharging openings at the bottom of the process area. This has the advantage that the discharging can be accomplished by means of gravity forces without additional discharging means.

In further preferred embodiments of the method the material that is to be fragmented or weakened, respectively, is continuously or batch-wise fed to the process area and fragmented or weakened material, respectively, is continuously or batch-wise discharged from the process area. It is e.g. envisaged to feed the material that is to be fragmented or weakened, respectively, batch-wise and to discharge the fragmented or weakened material, respectively, continuously, or vice versa. Also it is envisaged, of course, to perform the feeding as well as the discharging continuously (pure continuous operation) or to perform both batch-wise (pure batch operation). Depending on the configuration of the plant and on the material that is to be treated, either of these variants may be more advantageous.

In still a further preferred embodiment of the method the electrical conductivity of the process liquid which is present in the process area, the electrical conductivity of the process liquid which is discharged from the process area and/or the discharging resistance between the two electrodes is determined, and in dependence of the determined values the feeding of process liquid into the process area and/or, where applicable, the conditioning of the process liquid is changed, preferably is controlled. In this way it becomes possible to automatize a stable conducting of the process.

A second aspect of the invention concerns a method, preferably according to the first aspect of the invention, for fragmenting and/or weakening of material, preferably of rock material or ore, by means of high voltage discharges. The term fragmentation means here a comminution of the material, the term weakening (also termed pre-weakening) means here a generation of internal cracks inside the material, which facilitates a further, in particular mechanical, comminution of the material. According to this method, the material that is to be fragmented or weakened, respectively, together with a process liquid is introduced into a process area, in which two electrodes are facing each other at a distance and by doing so form between them a high voltage discharge gap within the process area. The material that is to be fragmented or weakened, respectively, and the process liquid are arranged within the process area in such a way that the area between the two electrodes is filled with material that is to be fragmented or weakened, respectively, and process liquid. Between the two electrodes, high voltage discharges are generated for fragmenting and/or weakening the material which has been introduced into the process area. In doing so, according to the invention, the material that is to be fragmented or weakened, respectively, is continuously or batch-wise fed into the process area and material is continuously or batch-wise discharged from the process area, wherein at least a part of the material which is discharged from the process area is fed back into the process area after is has undergone a further process step outside of the process area.

It has shown that by this measure, in particular in case that the further process step comprises a rinsing of the material that is to be fed back into the process area with a first rinsing liquid, which is preferred, preferably with a first rinsing liquid having a lower conductivity than the process liquid which is present in the process area, in the electrodynamic methods known today the energy efficiency and the capability of comminuting hard and brittle materials can considerably be improved and in case of problematic materials a change from an electrodynamic acting mode to an electrohydraulic acting mode can be prevented or at least slowed down. Furthermore this measure make possible now the application of the electrodynamic methods for the comminution or weakening, respectively, of materials for which they have been not suitable so far.

The term "rinsing" means here a contacting of the material with the first rinsing liquid in the broadest sense. Thus, it is e.g. envisaged to place the material in a basin filled with the first rinsing liquid or to flush the material with the first rinsing liquid.

In a preferred embodiment of the method, in which the further process step comprises a rinsing of the material that is to be fed back into the process area with a first rinsing liquid, preferably with a first rinsing liquid having a lower conductivity than the process liquid which is present in the process area, between the end of the rinsing of the material with the first rinsing liquid and the subsequent feeding back of the material into the process area, or, even more preferred, the charging of the material with high voltage discharges in the process area less than 5 minutes, in particular less than 3 minutes, pass.

In particular in case that the first rinsing liquid used for rinsing is similar, preferably identical to the process liquid which is fed into the process area, for material which in contact with the liquid release ions into the liquid, the advantage is arrived at that the freighting of the process liquid in the process area with ions by this can considerably be reduced, with the result that a better fragmentation or weakening efficiency, respectively, can be achieved.

For this, in a further improved embodiment of the method the first rinsing liquid used for rinsing is circulated in a circuit and is continuously or temporarily conditioned by withdrawal of ions, by dilution with process liquid of lower conductivity, by withdrawal of fines, by changing of its pH-value and/or by adding of complexing agents.

In a further preferred embodiment of the method, the material discharged from the process area, preferably by screening, is separated into coarse material and fines. The coarse material is fed back into the process area after it has undergone the further process step outside of the process area. In this way, in particular in methods in which a fragmentation of the material takes place, the discharge of the material that has been fragmented to target size and of the material that is circulated can be combined and by that be facilitated. Preferably, the separation into coarse material and fines takes place before the further process step is performed. By this, the advantage is arrive at that only the material that is to be fed back to the process area undergoes the further process step.

In that case it is further preferred that the amount of coarse material which is obtained by the separation into coarse material and fines is larger than the obtained amount of fines, thus the re-circulated amount of material is larger than the amount which is comminuted to target size. In particular in case that the further process step comprises a rinsing of the material that is to be fed back into the process area with a rinsing liquid which is similar, preferably identical to the process liquid fed into the process area, and materials are treated, which in contact with the process liquid release ions therein, by this the advantage is arrived at that the freighting of the process liquid in the process area with ions still further can be reduced, since by this it is possible in a continuous process to feed into the process area more "washed" recirculation material than "non-washed" new material.

In still a further preferred embodiment of the method, in which the further process step comprises a rinsing of the material that is to be fed back into the process area with a first rinsing liquid, the electrical conductivity of the first rinsing liquid used for rinsing is determined and thereafter in dependency of the determined values the feeding of the first rinsing liquid used for rinsing and/or, where applicable, the conditioning of the first rinsing liquid is changed, namely preferably controlled. In this way it is possible to automatize a stable conducting of the process.

A third aspect of the invention concerns a method, preferably according to the first or the second aspect of the invention, for fragmenting and/or weakening of material, preferably of rock material or ore, by means of high voltage discharges. The term fragmentation means here a comminution of the material, the term weakening (also termed pre-weakening) means here a generation of internal cracks inside the material, which facilitates a further, in particular mechanical comminution of the material. According to this method, the material that is to be fragmented or weakened, respectively, together with a process liquid is introduced into a process area, in which two electrodes are facing each other at a distance and by doing so form between them a high voltage discharge gap within the process area. The material that is to be fragmented or weakened, respectively, and the process liquid are arranged within the process area in such a way that the area between the two electrodes is filled with material that is to be fragmented or weakened, respectively, and process liquid. Between the two electrodes, high voltage discharges are generated for fragmenting and/or weakening the material which has been introduced into the process area. In doing so, according to the invention, the material which has be introduced into the process area, antecedent to the fragmentation or weakening, respectively, is rinsed with a second rinsing liquid having a lower conductivity than the process liquid which is present in the process area during fragmentation or weakening, respectively.

It has shown that by this measure, in particular in case that the second rinsing liquid is similar, preferably identical to the process liquid which is fed into the process area, which is preferred, and that materials are treated which in contact with the liquid release ions into this liquid, in the electrodynamic methods known today the energy efficiency can considerably be improved and in case of problematic materials a change from an electrodynamic acting mode to an electrohydraulic acting mode can be prevented or at least slowed down.

In one preferred embodiment, the rinsing with the second rinsing liquid takes place within the process area, in another it takes place outside of the process area. The term "rinsing" means here a contacting of the material with the second rinsing liquid in the broadest sense. Thus, it is e.g. envisaged to place the material before it is fed into the process area in a basin filled with the second rinsing liquid or to flush the material with the second rinsing liquid. Furthermore, it is envisaged to flood the process area filled with the material that is to be treated antecedent to the generating of high voltage discharges for a certain time with the second rinsing liquid and thereafter and antecedent to the generating of high voltage discharges to replace it by process liquid, or alternative to rinse the material which has been fed into the process area before the feeding of the process liquid into the process area and the generating of high voltage discharges inside the process area with the second process liquid. Also combinations are envisaged, of course, as well as a multiple placing in liquid, flooding and/or rinsing, e.g. also in intervals between a charging of the material with high voltage discharges.

Preferably, between the end of the rinsing of the material with the second rinsing liquid, or, even more preferred, the charging of the material with high voltage discharges in the process area, less than 5 minutes, in particular less than 3 minutes pass. In particular in case that the second rinsing liquid used for rinsing is similar, preferably identical to the process liquid which is fed into the process area, for materials which in contact with the liquid release ions therein, the advantage is arrived at that by this the freighting of ions of the process liquid in the process area can still further be reduced, since a new increase in ion concentration at the surface of the material can substantially be prevented with the result that still a better fragmentation or weakening efficiency, respectively, can be achieved.

In a further preferred embodiment of the method, the second rinsing liquid used for rinsing is circulated in a circuit and is continuously or temporarily conditioned by withdrawal of ions, by dilution with process liquid of lower conductivity, by withdrawal of fines, by changing of its pH-value and/or by adding of complexing agents. These individual measures are known to the person skilled in the art and therefore do not need to be explained here more into detail. By this, the advantage is arrived at that the consumption of second rinsing liquid can be kept on a very low level and at the same time it is possible to also keep the amount of waste that needs to be disposed of can be kept low.

In still a further preferred embodiment of the method the electrical conductivity of the second rinsing liquid used for rinsing is determined and in dependency of the determined values the feeding of the second rinsing liquid used for rinsing and/or, where applicable, the conditioning of the second rinsing liquid is changed, namely preferably controlled. In this way it is possible to automatize a stable conducting of the process.

Preferably, in the methods according to the first, second and third aspect of the invention, water is used as process liquid. Same is cost-effective and in practice has proven very well suitable for such methods.

Also it is preferred in the methods according to the first, second and third aspect of the invention that a precious metal ore or semiprecious metal ore is used as material that is to be fragmented and/or weakened, preferably a copper ore or a copper/gold ore. With such materials the advantages of the invention become especially clearly apparent.

Further, it is preferred in the methods according to the first, second and third aspect of the invention that a preferably mechanical comminution of the fragmented or weakened material, respectively, which results from the method, takes place. This is in particular the case in methods, which to a lesser extend serve for fragmentation and to a larger extend serve for weakening of the material.

A fourth aspect of the invention concerns a high voltage electrode for a process area for conducting one of the methods according to the first, second and third aspect of the invention. The high voltage electrode comprises an isolator body with a central conductor, preferably made of metal, in particular of copper, a copper alloy or of stainless steel, at the working end of which, which end axially protrudes out of the isolator body, an electrode tip is arranged, which by advantage has the shape of a spherical calotte or of a paraboloid of revolution. The central conductor and/or the isolator comprise at the working end one or several feeding openings for the feeding of process liquid into the process area which is to be formed with this high voltage electrode, which open into one or several feeding channels inside the high voltage electrode, via which these feeding openings can be fed from a location remote to the working end, preferably from the non-working end of the high voltage electrode, with a process liquid, preferably water. Such a high voltage electrode has the advantage that, when using it, separate arrangements for feeding process liquid can be dispensed with and that practically necessarily a feeding of process liquid in the area of the reaction zone of the process area takes place, which is desirable.

In a preferred embodiment of the high voltage electrode, the central conductor at its working end comprises one or several feeding openings arranged on its face side for feeding process liquid into the process area, namely preferably one central feeding opening and/or several feeding openings arranged concentrically around the centre of the electrode. By this, a purposeful feeding of process liquid into the reaction zone becomes possible.

Also preferred are embodiments of the high voltage electrode in which the central conductor at its working end comprises one or several feeding openings arranged at its circumference, which by advantage are equally distributed at its circumference. By this, a slightly more diffuse feeding of the process liquid into the reaction zone becomes possible.

Depending on the geometry of the process area that is to be provided with the high voltage electrode, either of these variants or a combination thereof can be more preferable.

Preferably, the central conductor in the area where it exits on the working end side out of the isolator body comprises at its outer circumference a circumferential radial ridge, which serves as field relief. In that case it is further preferred that the face side of this ridge comprises feeding openings.

In case the central conductor for feeding of the process liquid to the feeding openings comprises a central feeding channel, which is preferred, there is the advantage that a simple, cost-effective design of the high voltage electrode becomes possible. A further advantage which arises is that a central longitudinal bore hole inside a high voltage electrode has the smallest possible effect on its current conduction capability in the intended use.

Further, it is alternatively or additionally preferred that the isolator body of the high voltage electrode on its working end sided front face comprises one or several feeding openings, namely preferably several feeding openings arranged around the centre of the electrode, that the isolator body is surrounded by a further element, which as such or in combination together with the isolator body forms an annular gap on the face side and/or that the isolator body is surrounded by a further element which forms an arrangement of feeding orifices. These feeding openings, gaps and/or orifices can be fed from a location remote to the working end, preferably from the non-working end of the high voltage electrode, with process liquid, preferably water. By this, also a relative purposeful feeding of process liquid into the reaction zone becomes possible.

A fifth aspect of the invention concerns a process area with a high voltage electrode according to the fourth aspect of the invention for conducting a method according to the first, second or third aspect of the invention.

A sixth aspect of the invention concerns a process vessel forming a preferably closed process area according to the fifth aspect of the invention.

A seventh aspect of the invention concerns a plant for fragmenting and/or weakening of material, preferably of rock material or ore, by means of high voltage discharges. The plant comprises a process vessel according to the sixth aspect of the invention as well as a high voltage pulse generator for charging the high voltage electrode according to the fourth aspect of the invention with high voltage pulses in order to generate high voltage discharges in the process area formed by the process vessel.

BRIEF DESCRIPTION OF THE DRAWINGS

Further embodiments, advantages and applications of the invention result from the dependent claims and from the following description on the basis of the drawings. Therein show:

MODES FOR CARRYING OUT THE INVENTION

Figure 1:
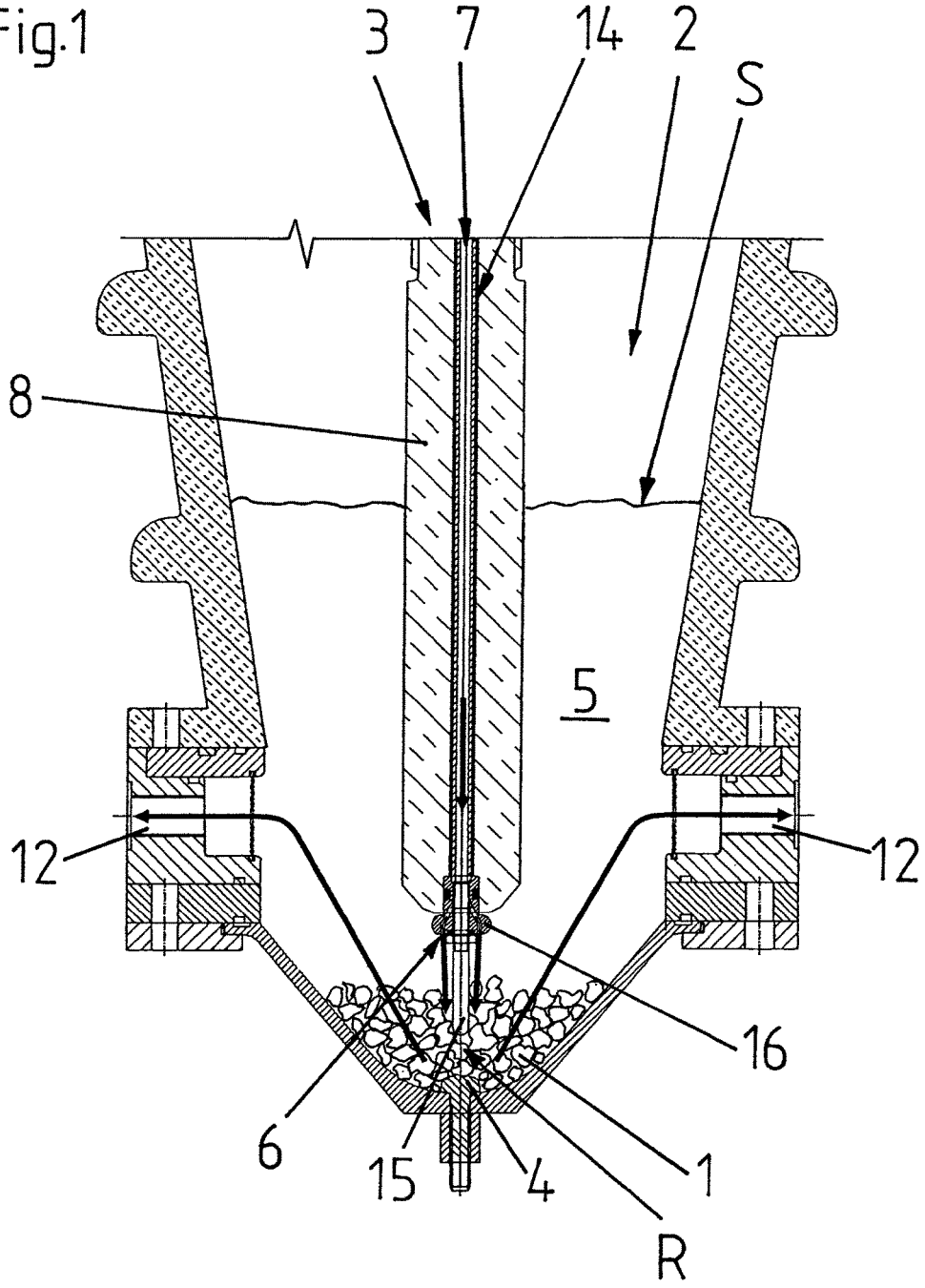
FIG. 1 a vertical section through a part of a first process vessel according to the invention during the conducting of a method according to the invention.

FIG. 1 shows the lower part of a first process vessel according to the invention in vertical section during the conducting of a method according to the invention.

As can be seen, the process vessel forms a closed process area 2 according to the invention, at the bottom of which an electrode 4 is arranged, which is on ground potential. The process area 2 is approximately half filled (see liquid level S) with a process liquid 5, in the present case water. The funnel-shaped bottom of the process area 2 is covered with a filling of material 1 that is to be fragmented, in the present case pieces of rock. From above, a rod-shaped high voltage electrode 3 according to the invention extends into the process area 2.

Figure 2:
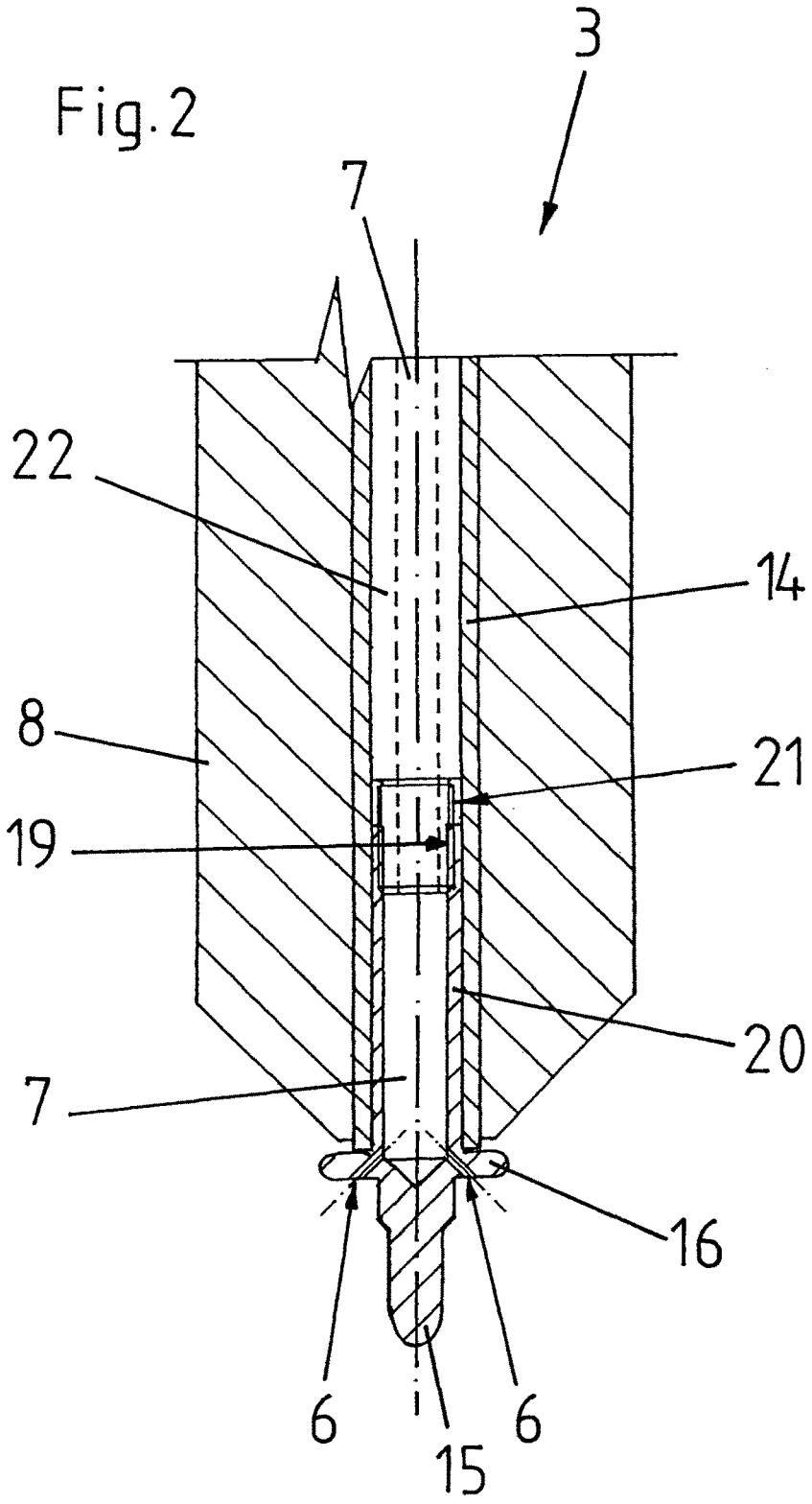
FIG. 2 a vertical section through a part of a first high voltage electrode according to the invention.

As can be seen in combination with FIG. 2, which shows the front part of the high voltage electrode 3 in a detailed sectional representation, the part of the high voltage electrode 3 which is visible here is formed by an isolator body 8 with a central conductor 14, at the end of which, which end axially protrudes out of the isolator body 8, a rod-shaped electrode tip 15 is arranged. The central conductor 14 or the electrode tip 15 which forms its working side end, respectively, comprises in the area directly adjacent to the working end sided front face of the isolator body 8 at its outer circumference a circumferential radial ridge 16, which serves as field relief. The electrode tip 15 and the ridge 16 are commonly formed as a one-piece exchange part made of stainless steel, which by means of an inner thread 19 that is formed at the end of an anti-fatigue sleeve 20, is threaded onto an outer thread 21 of a tension rod 22, which extends inside the central conductor 14, in such a way that the front face of the ridge 16 which is facing towards the isolator body 8 abuts under compressive pre-stress against the working end sided front face of the central conductor 14.

The high voltage electrode 3 dips with its electrode tip 15 into the filling of pieces of rock 1, which is present at the bottom of the process area 2, in such a way that between the front face of the electrode tip 15 of the high voltage electrode 3 and the front face of the bottom electrode 4 there remains an area (reaction zone) which is filled with pieces of rock 1 and process liquid 5.

At its front face which is facing away from the isolator body 8, the ridge 16 comprises several feeding openings 6 for process liquid 5 which are with an equal angular pitch arranged concentrically around the centre of the electrode, which openings are continuously fed with process liquid 5 from the non-working end of the high voltage electrode 3 via a central feeding channel 7 which extends in the centre of the tension rod 22 and through the anti-fatigue sleeve 20 (see arrows). By this, continuously fresh process liquid is fed into the reaction zone R, in which by charging the high voltage electrode 3 with high voltage pulses, high voltage discharges are generated between the bottom electrode 4 and the high voltage electrode 3, and by doing so, old process liquid 5 and fines are displaced out of the reaction zone R. At the same time, the same amount of process liquid is discharged from the process area 2 via radial discharging openings 12 above the reaction zone R (see arrows) and is fed to a process liquid treatment plant (not shown), in which the particle load is removed and the electrical conductivity of the process liquid 5 is reduced. The process liquid 5 treated in this way is, via the feeding openings 6 in the high voltage electrode 3, fed back into the process area 2. In this way, a process liquid circuit is formed by which the reaction zone continuously is flushed with reprocessed process liquid 5.

Figure 3:
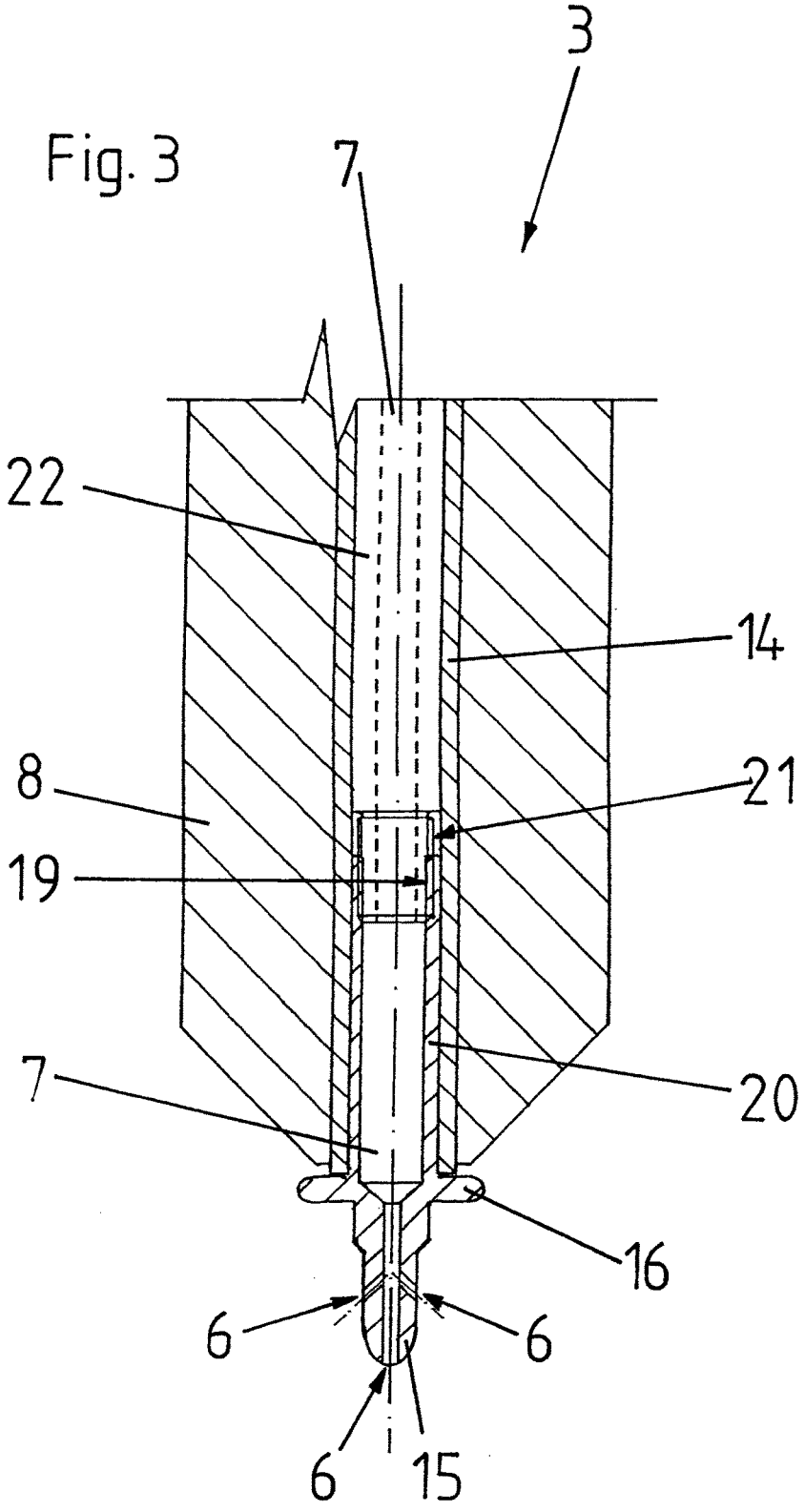
FIG. 3 a vertical section through a part of a second high voltage electrode according to the invention.

FIG. 3 shows a vertical section through the working sided end of a second high voltage electrode 3 according to the invention, which differs from the one shown in FIG. 2 merely in that the feeding openings 6 for the process liquid 5 are not arranged at the face of the ridge 16 but at the circumference of the rod-shaped electrode tip 15.

Figure 4:
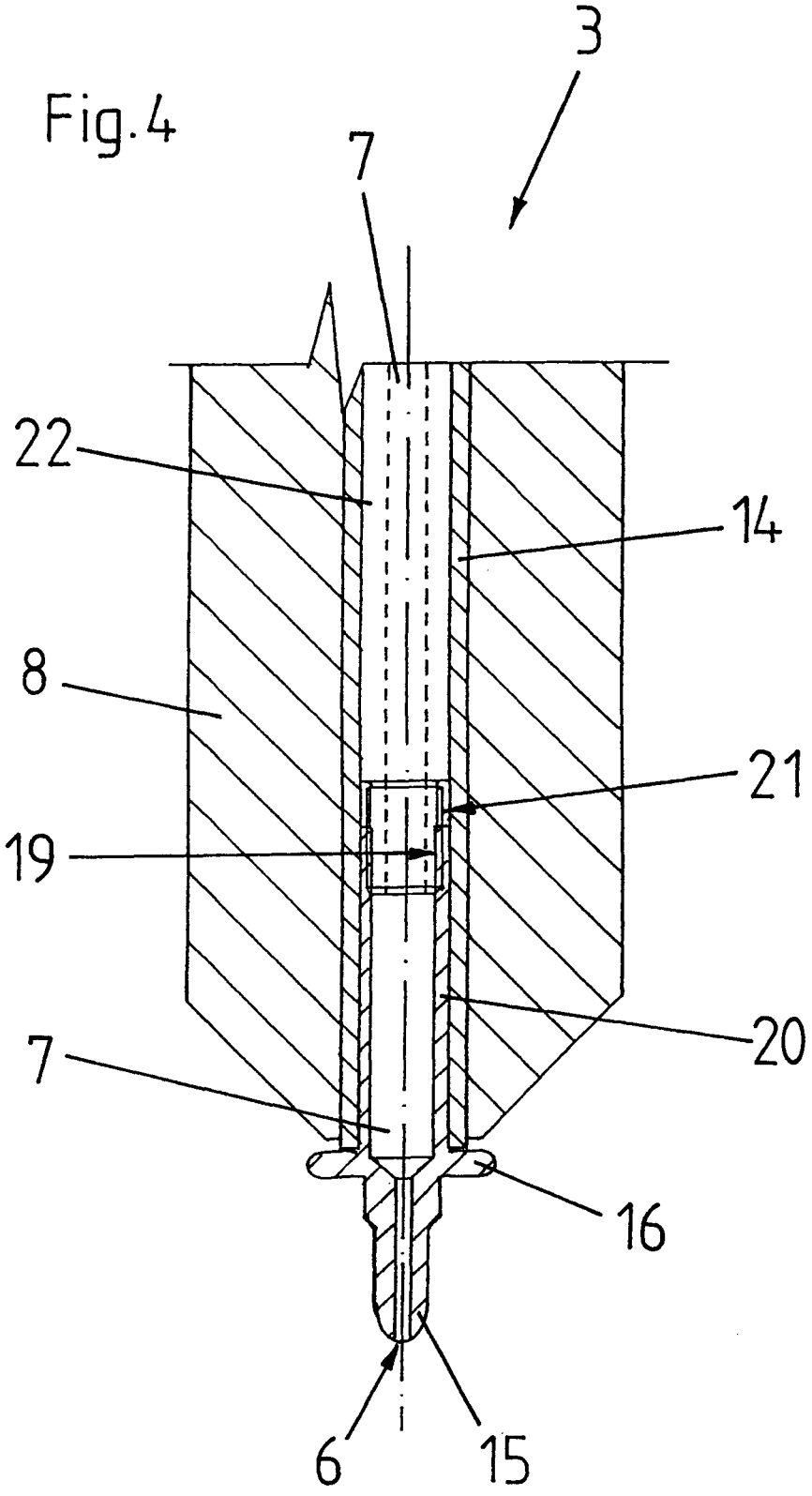
FIG. 4 a vertical section through a part of a third high voltage electrode according to the invention.

FIG. 4 shows a vertical section through the working sided end of a third high voltage electrode 3 according to the invention, which differs from the one shown in FIG. 2 in that there are not arranged several feeding openings 6 for the process liquid 5 at the face of the ridge 16 but that merely one central feeding opening 6 is arranged at the face of the rod-shaped electrode tip 15.

Figure 5:
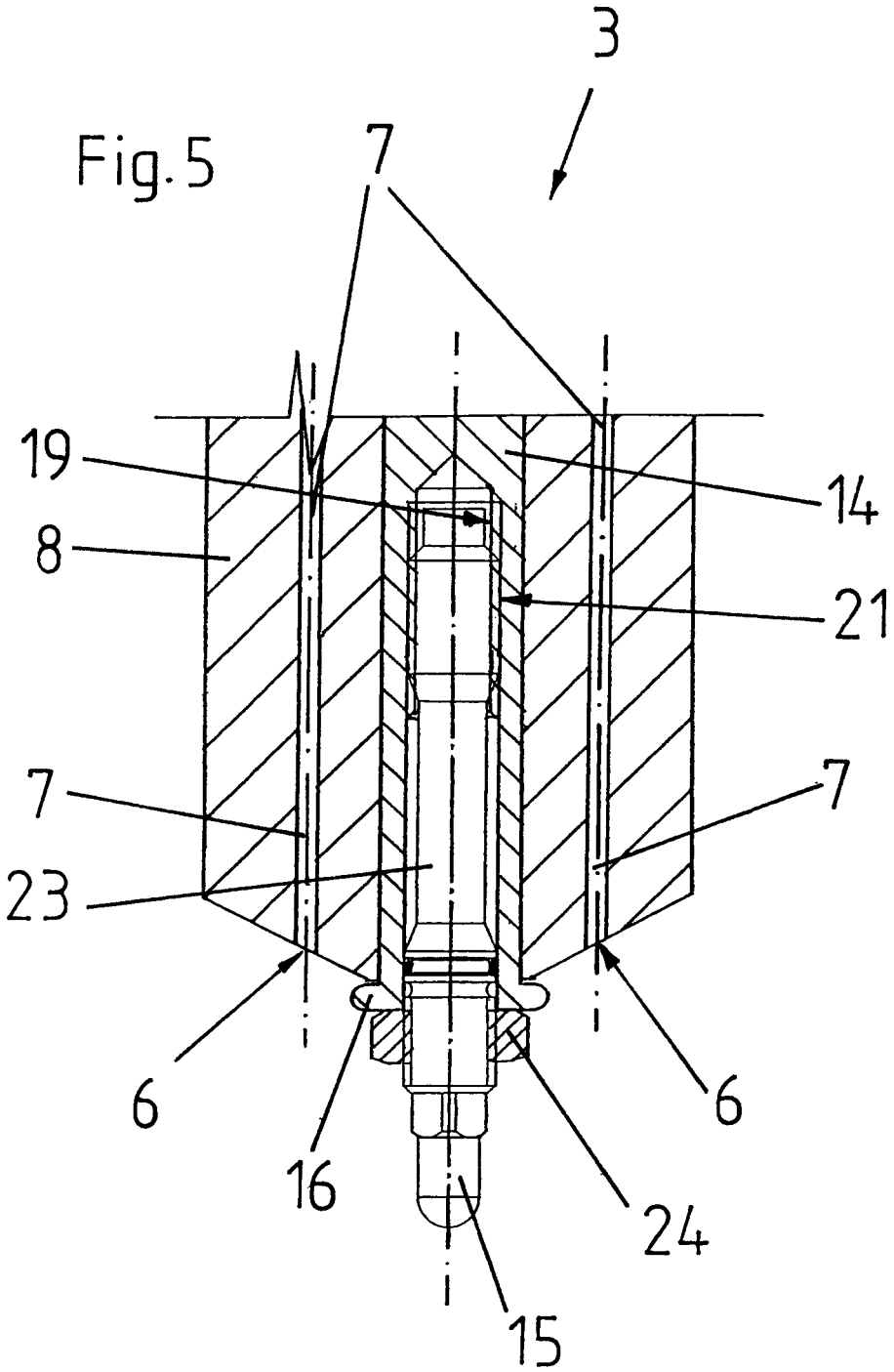
FIG. 5 a vertical section through a part of a fourth high voltage electrode according to the invention.

FIG. 5 shows a vertical section through the working sided end of a fourth high voltage electrode 3 according to the invention, which generally differs from the high voltage electrodes 3 shown in the FIGS. 2, 3 and 4 in that the feeding openings 6 are not formed by the central conductor 14 or the electrode tip 15, respectively, but are formed by the isolator body 8, at the working sided face of which several feeding channels 7 end thereby forming feeding openings 6. The central conductor 14 in the present case is designed as solid metal rod and, in the area where it at the working end side protrudes out of the isolator body 8, forms at its outer circumference a circumferential radial ridge 16, which also here serves as field relief. The electrode tip 15 again is designed as exchange part, however here in the form of an anti-fatigue bolt 23, which by means of an end-sided outer thread 21 is screwed into an inner thread 19 in the central conductor 14 and by means of a nut 24, which is screwed onto its end which is forming the electrode tip 15, under compressive pre-stress abuts against the face of the central conductor 14.

Figure 6:
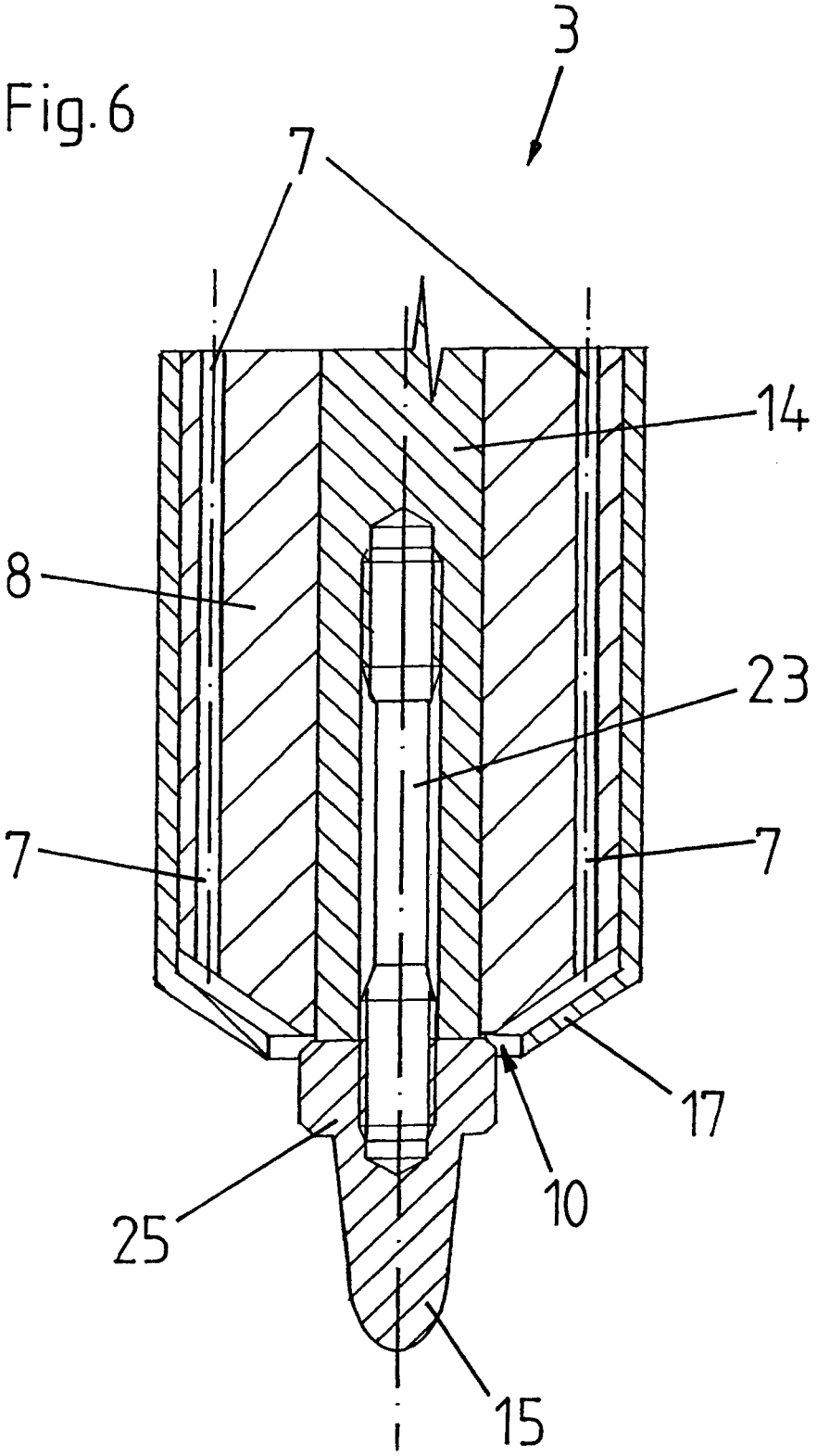
FIG. 6 a vertical section through a part of a fifth high voltage electrode according to the invention.

FIG. 6 shows a vertical section through the working sided end of a fifth high voltage electrode 3 according to the invention, which differs from the one shown in FIG. 5 in that the isolator body 8 of the electrode 3 is surrounded by a bushing like component 17 which covers a part of its working end sided face and together with the isolator body 8 form an annular gap 10, which from the non-working end of the high voltage electrode 3 can, via the feeding channels 7, be fed with process liquid.

The electrode tip 15 is formed here from a cap nut 25, which by means of an anti-fatigue bolt 23 that is screwed into same is fastened in a tapped blind hole in the face of the central conductor 14 and under compressive pre-stress abuts against this face of the central conductor 14. As can be seen, a further difference with respect to the high voltage electrode shown in FIG. 5 consists in that the central conductor 14 here in the area where it exits the isolator body 8 does not form a ridge.

Figure 7:
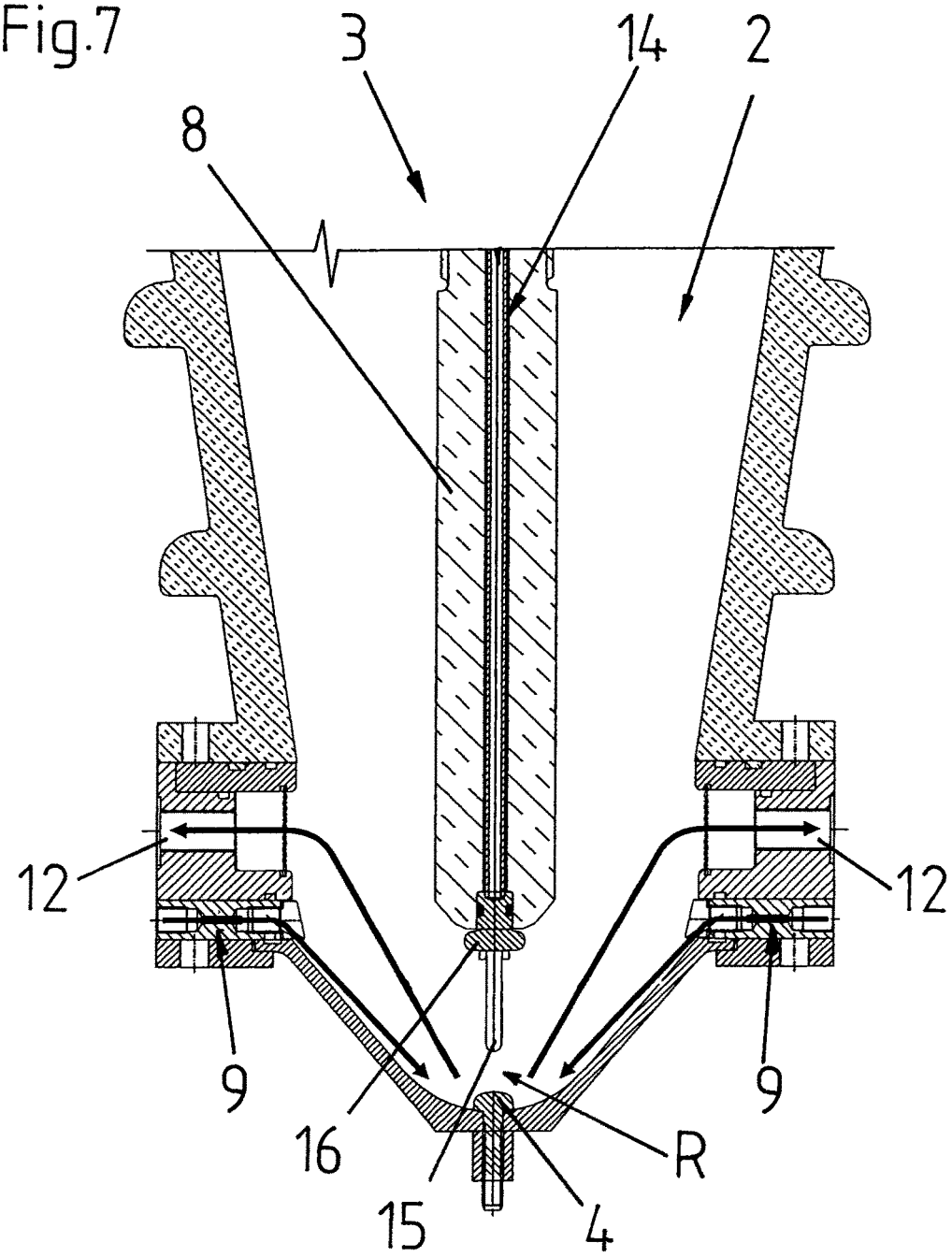
FIG. 7 a vertical section through a part of a second process vessel according to the invention.

FIG. 7 shows the lower part of a second process vessel according to the invention in vertical section. The process vessel shown here differs from the one shown in FIG. 1 merely in that for the feeding of the process liquid there is not used a high voltage electrode with feeding openings but an arrangement of feeding orifices 9, which are arranged above the reaction zone R evenly distributed at the boundary walls of the process vessel and in the intended use in each case generate a process liquid jet which is directed towards the bottom electrode 4 (see arrows). The discharging of the process liquid in the intended use takes place, as in the process vessel shown in FIG. 1, via radial discharge openings 12 above the reaction zone R (see arrows).

Figure 8:
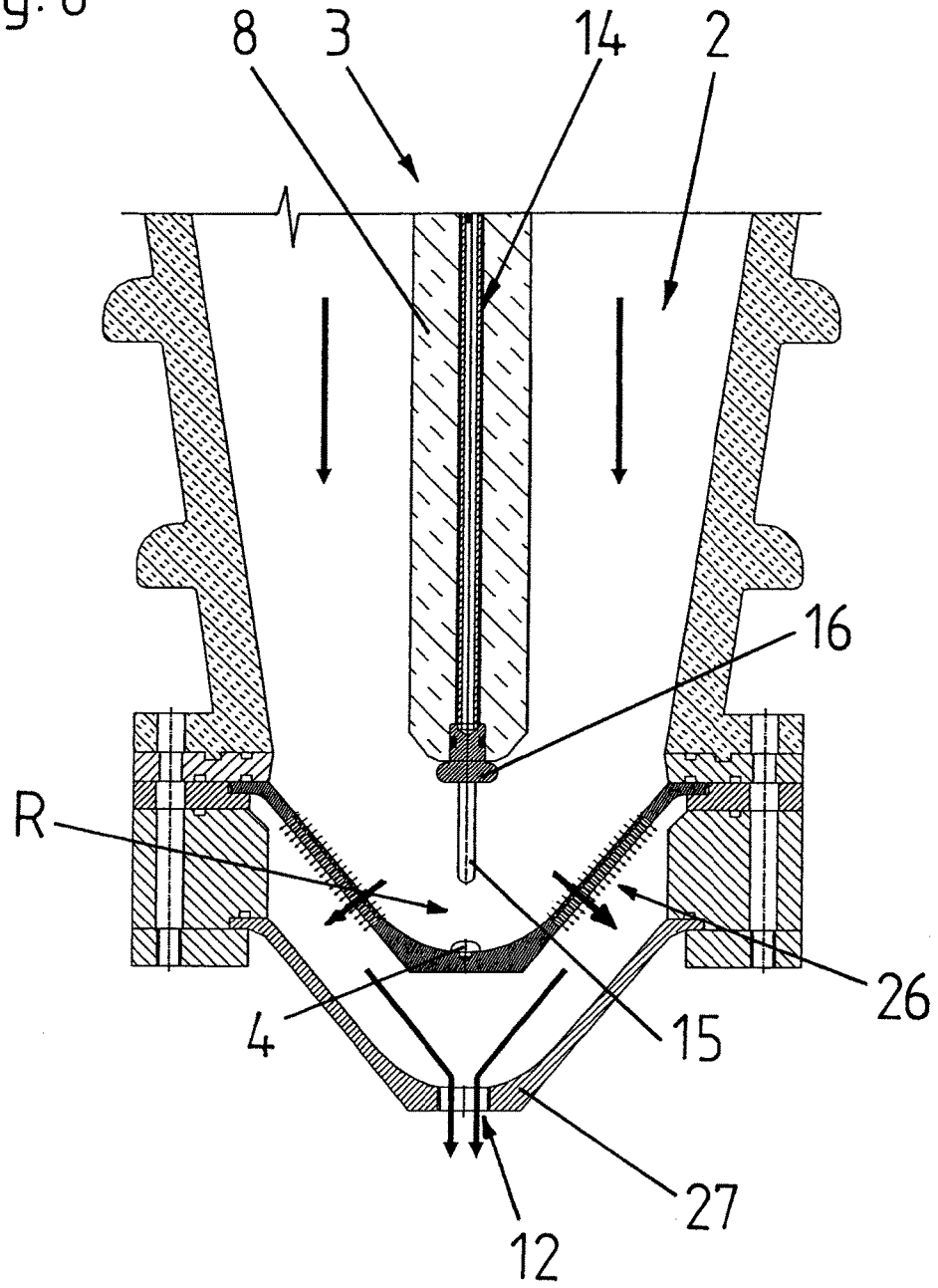
FIG. 8 a vertical section through a part of a third process vessel according to the invention.

FIG. 8 shows the lower part of a third process vessel according to the invention in vertical section. In the process vessel shown here, in the intended use the feeding of process liquid takes place via (not shown) feeding openings from above. The bottom electrode 4 is carried by a thieve bottom 26, via which in the intended use process liquid is fed to the actual bottom 27 of the process vessel and via a central discharge opening 12 is discharged. The high voltage electrode 3 is substantially identical to the one of the process vessel of FIG. 7.

Figure 9:
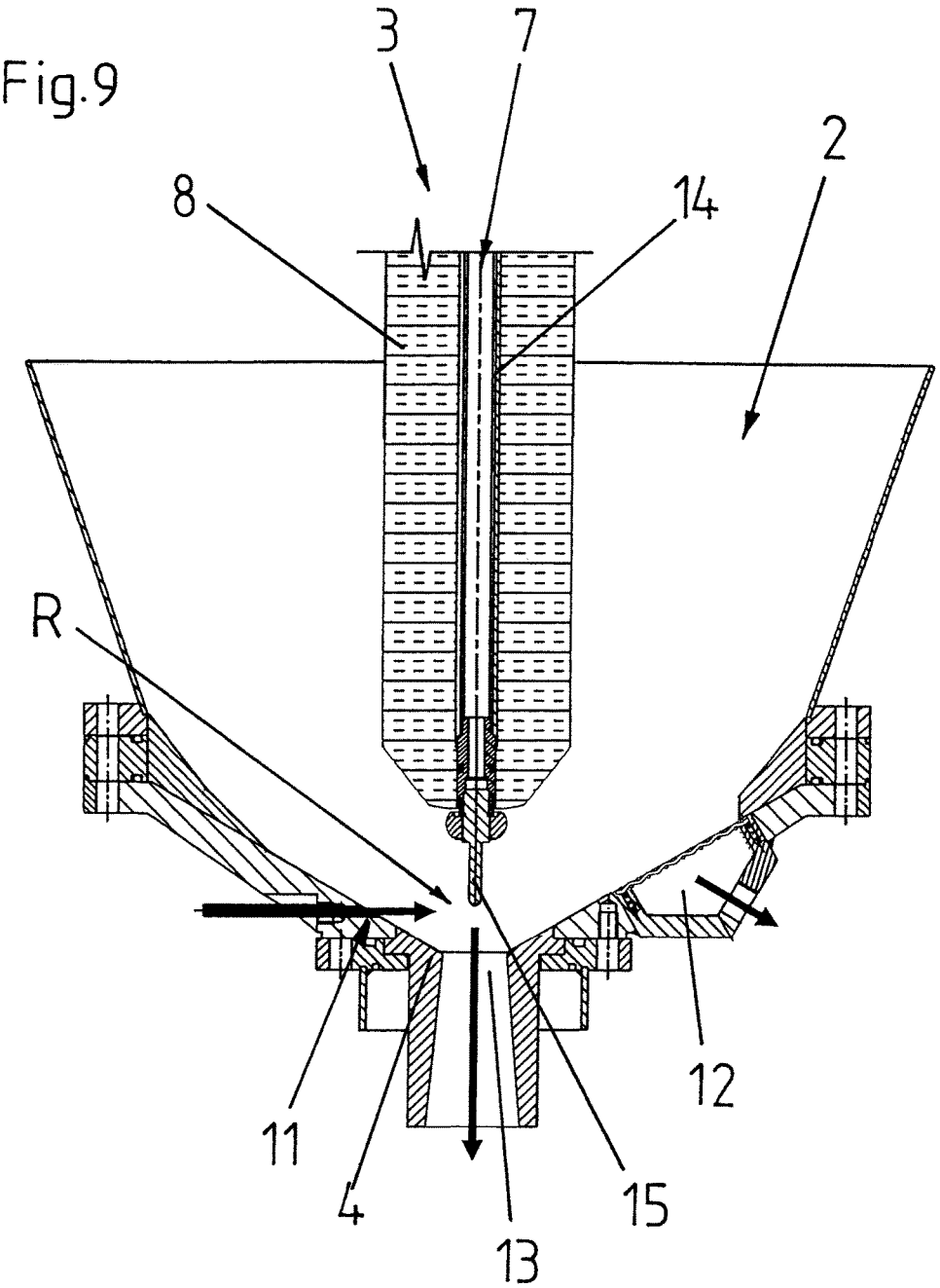
FIG. 9 a vertical section through a part of a fourth process vessel according to the invention FIG. 10 a vertical section through a part of a fifth process vessel according to the invention.

FIG. 9 shows a fourth process vessel according to the invention in vertical section. As can be seen, the process vessel here forms a process area 2 according to the invention which is open at the top, at the funnel-shaped bottom of which there is arranged a bottom electrode 4 which comprises a central discharging bore hole 13 for material that has been comminuted to target size. From above, a rod-shaped high voltage electrode 3 projects into the process area 2, which consists of an isolator body 8 with a central conductor 14, at the working end of which, which end axially protrudes out of the isolator body 8, a rod-shaped electrode tip 15 is arranged. The central conductor 14 or the electrode tip 15 forming the working sided end of same, respectively, in the area direct adjacent to the working end sided face of the isolator body 8 at its outer circumference comprises a circumferential radial ridge 16, which serves as field relief. At a location near the bottom electrode 4, the bottom of the process vessel comprises an orifice 11 for the feeding of process liquid, by means of which in the intended use a process liquid stream which is directed towards the reaction zone can be generated (see arrow). At an opposite position, the bottom of the process vessel comprises a discharging opening 12 for process liquid (see arrow).

Figure 10:
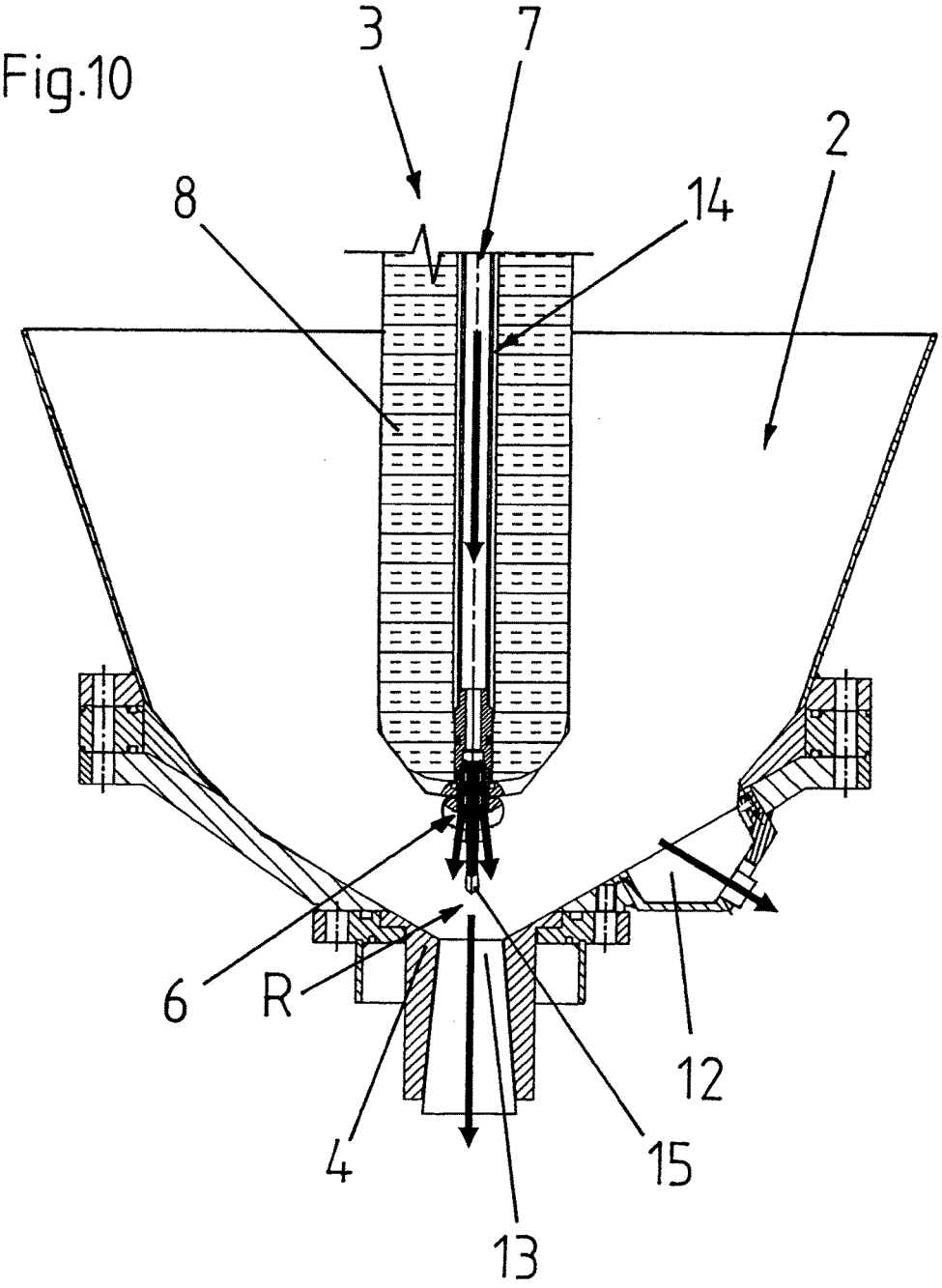

FIG. 10 shows a fifth process vessel according to the invention in vertical section, which differs from the one shown in FIG. 9 merely in that for the feeding of the process liquid there does not exist a bottom orifice, but a high voltage electrode 3 having feeding openings 6 (see arrows). This high voltage electrode 3 with respect to the arrangement of the feeding openings 6 is identical to the high voltage electrodes shown in the FIGS. 1 and 2.

Figure 11:
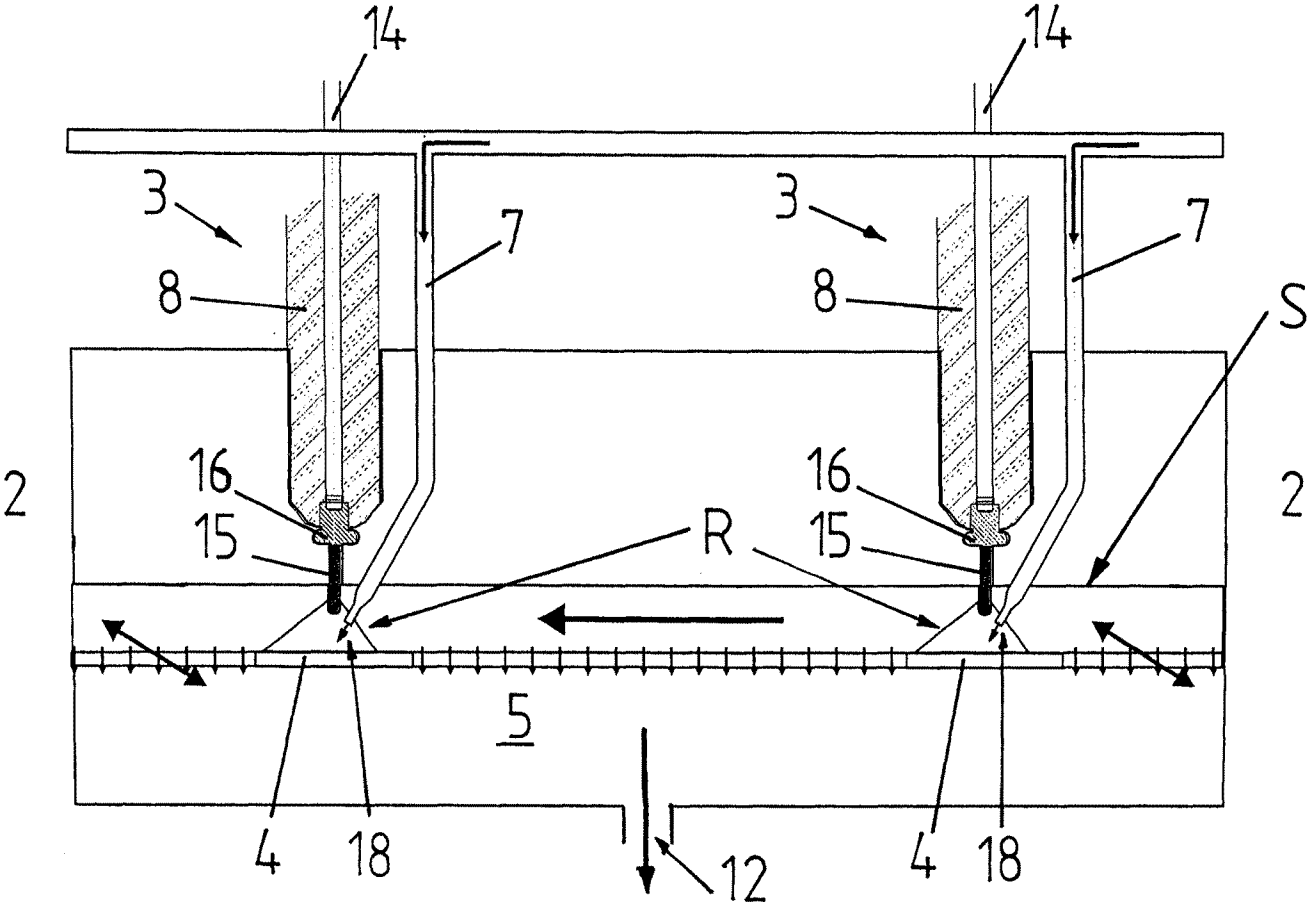
FIG. 11 a vertical section through a process area according to the invention having two reaction zones.

FIG. 11 shows, in a very schematized manner, a vertical section through a process area 2 according to the invention of a plant for weakening pieces of ore according to the invention, which process area is having two separate reaction zones R. In the process area 2, a vibrating screen deck 28 is arranged, which comprises two electrode areas 4 which are grounded. Above each of the electrode areas 4, in each case at a vertical distance a rod-shaped high voltage electrode 3 is arranged, which with respect to its design is similar to the one shown in the FIGS. 7 and 8. The process area 2 is filled up to half of its height with process liquid 5 (see liquid level S).

In the intended use, pieces of ore that are to be weakened are conveyed, due to a vibrating action of the vibrating screen deck 28, from right to left through the area under the high voltage electrodes 3, while high voltage discharges are generated between the high voltage electrodes 3 and the electrode areas 4. In doing so, in each case the area, in which high voltage discharges take place (reaction zone R), is fed with process liquid 5 via flushing orifices 18 (see arrows). At the same time, at the bottom of the process area 2, the same amount of process liquid 5 is discharged via discharging openings 12 (see arrows) and is fed to a process liquid treatment plant (not shown), in which it is treated and is reduced in its electrical conductivity. The process liquid 5 which has been reprocessed in that way is fed back to the process area 2 via the flushing orifices 18. In this way, also here a process liquid circuit is formed, by means of which the reaction zones R are continuously flushed with reprocessed process liquid 5.

While there are shown and described in the present application text preferred embodiments of the invention it is to be distinctly understood that the invention is not limited thereto but may be otherwise variously embodied and practiced within the scope of the following claims.

The invention claimed is:

1. A method of fragmenting or weakening of material by high voltage discharges, comprising the steps:

a) providing a process area having a high voltage discharge gap formed between two electrodes which face each other at a distance;

b) feeding the material that is to be fragmented or weakened and a process liquid into the process area in such a way that in the intended fragmentation or weakening operation the area between the two electrodes is filled with the material that is to be fragmented or weakened and the process liquid; and c) fragmenting or weakening the material in the process area by generating high voltage discharges between the two electrodes;

d) discharging process liquid from the process area and feeding process liquid into the process area during the fragmenting or weakening of the material, wherein the fed process liquid has a lower electrical conductivity than the discharged process liquid;

e) determining a value of at least one of: an electrical conductivity of the process liquid which is present in the process area, an electrical conductivity of the discharged process liquid, or a discharging resistance between the two electrodes; and f) changing, in dependence of the determined value, at least one of: the feeding of the process liquid into the process area or conditioning of the process liquid.

2. The method according to claim 1, wherein the electrical conductivity of the fed process liquid is in a range between 0.2 micro-Siemens per cm and 5000 micro-Siemens per cm.

3. The method according to claim 1, wherein the discharging and feeding of the process liquid takes place simultaneously.

4. The method according to claim 1, wherein the fed and discharged process liquids have volumes that are substantially identical.

5. The method according to claim 1, wherein the feeding and discharging of the process liquid takes place continuously or in intervals.

6. The method according to claim 1, further comprising:

conditioning the discharged process liquid to reduce the electrical conductivity thereof; and completely or partially feeding the conditioned discharged process liquid back into the process area.

7. The method according to claim 6, wherein conditioning the discharged process liquid comprises conditioning by at least one of: withdrawal of ions, dilution with process liquid of lower electrical conductivity, withdrawal of fines, changing of a pH-value thereof, or adding of complexing agents.

8. The method according to claim 6, wherein:

discharging the process liquid from the process area comprises circulating the discharged process liquid into a process liquid treatment plant, conditioning the discharged process liquid comprises conditioning the discharged process liquid in the process liquid treatment plant, and completely or partially feeding the conditioned discharged process liquid back into the process area comprises completely or partially feeding the conditioned discharged process liquid back into the process area from the liquid treatment plant.

9. The method according to claim 1, wherein the feeding of the process liquid into the process area comprises feeding the process liquid into a reaction zone between the two electrodes.

10. The method according to claim 1, wherein the feeding and discharging of the process liquid takes place in such a way that the fed process liquid passes through a reaction zone between the two electrodes.

11. The method according to claim 10, wherein the fed process liquid passes through the reaction zone between the two electrodes (a) from top to bottom, (b) from bottom to top, or (c) in a direction from a center of the reaction zone radially outwards.

12. The method according to claim 1, wherein the feeding of the process liquid takes place via one of the two electrodes or via both of the two electrodes.

13. The method according to claim 12, wherein the feeding of the process liquid comprises feeding of the process liquid via one or several feeding openings arranged on a face of the one of the two electrodes or faces of both of the two electrodes.

14. The method according to claim 13, wherein the feeding of the process liquid to the feeding openings takes place via a central feeding bore hole inside the one of the two electrodes or via central feeding bore holes inside both of the two electrodes.

15. The method according to claim 13, wherein the feeding of the process liquid comprises feeding of the process liquid via at least one of: a central feeding opening or several feeding openings arranged concentrically around a center of at least one of the two electrodes.

16. The method according to claim 12, wherein the two electrodes comprise one or two rod-shaped electrodes and the feeding of the process liquid comprises feeding of the process liquid via one or several feeding openings arranged around a circumference of the one rod-shaped electrode or around circumferences of the two rod-shaped electrodes.

17. The method according to claim 16, wherein the feeding of the process liquid comprises feeding of the process liquid via several feeding openings equally distributed over a circumference of at least one of the two electrodes.

18. The method according to claim 1, wherein at least one of the two electrodes is surrounded by an isolator and the feeding of the process liquid takes places via the isolator.

19. The method according to claim 18, wherein the feeding of the process liquid takes places via one or several feeding openings arranged on a face of the isolator.

20. The method according to claim 19, wherein the feeding of the process liquid comprises feeding of the process liquid via several feeding openings arranged concentrically around a center of the electrode at the isolator.

21. The method according to claim 1, wherein the feeding of the process liquid takes place via a concentric arrangement or arrangements of feeding orifices, which surround one or both of the two electrodes or an isolator extending therearound concentrically.

22. The method according to claim 1, wherein the feeding of the process liquid takes place via at least one annular gap, which concentrically surrounds at least one of the two electrodes or an isolator extending therearound.

23. The method according to claim 1, wherein providing the process area comprises arranging the two electrodes in a vertically stacked orientation, wherein a lower electrode in the vertically stacked orientation is disposed at a bottom of the process area.

24. The method according to claim 23, wherein the feeding of the process liquid takes place via one or several feeding openings arranged at the bottom of the process area.

25. The method according to claim 23, wherein the discharging of the process liquid takes place via one or several discharging openings arranged at the bottom of the process area.

26. The method according to claim 23, further comprising withdrawing fragmented or weakened material from the process area via one or several withdrawing openings arranged at the bottom of the process area.

27. The method according to claim 1, wherein the providing of the process area comprises arranging the two electrodes laterally adjacent one another, wherein both of the two electrodes comprise an isolator and are charged with a potential unequal to ground potential.

28. The method according to claim 1, further comprising withdrawing fragmented or weakened material from the process area, and wherein the discharging of the process liquid from the process area and the withdrawing of the fragmented or weakened material from the process area utilizes different openings.

29. The method according to claim 1, further comprising:

feeding the material that is to be fragmented or weakened continuously or batch-wise, to the process area; and discharging fragmented or weakened material continuously or batch-wise, from the process area.

30. The method according to claim 1, wherein water is used as the process liquid.

31. The method according to claim 1, wherein fragmenting or weakening the material comprises fragmenting or weakening a precious metal ore or semiprecious metal ore.

32. The method according to claim 31, wherein fragmenting or weakening the precious metal ore or semiprecious metal ore comprises fragmenting or weakening a copper ore or a copper/gold ore.

33. The method according to claim 1, further comprising performing a comminution of the fragmented or weakened material.

34. The method according to claim 33, further comprising performing a mechanical comminution of the fragmented or weakened material.

35. A method for fragmenting or weakening of material by high voltage discharges, comprising the steps:

a) providing a process area having a high voltage discharge gap formed between two electrodes which face each other at a distance;

b) feeding the material that is to be fragmented or weakened, continuously or batch-wise, and a process liquid into the process area in such a way that in the intended fragmentation or weakening operation the area between the two electrodes is filled with the material that is to be fragmented or weakened and the process liquid;

c) fragmenting or weakening the material in the process area by generating high voltage discharges between the two electrodes;

d) discharging fragmenting or weakened material, continuously or batch-wise, from the process area;

e) processing at least a part of the material which is discharged from the process area outside of the process area before feeding the at least a part of the material back into the process area, the processing comprising rinsing the material with a rinsing liquid; and f) determining an electrical conductivity of the rinsing liquid; and g) changing, in dependency of the determined electrical conductivity, at least one of: feeding of the rinsing liquid or conditioning of the rinsing liquid.

36. The method according to claim 35, wherein between an end of the rinsing of the material with the rinsing liquid and either the feeding the rinsed material back into the process area or charging of the material with high voltage discharges in the process area, less than 5 minutes pass.

37. The method according to claim 35, wherein the rinsing liquid is similar to the process liquid which is fed into the process area.

38. The method according to claim 35, further comprising:

circulating the rinsing liquid in a circuit; and continuously or temporarily conditioning the rinsing liquid by at least one of: withdrawal of ions, dilution with process liquid of lower conductivity, withdrawal of fines, changing of a pH-value thereof, or adding of complexing agents.

39. The method according to claim 35, further comprising:

separating the material discharged from the process area into coarse material and fines; and feeding only the coarse material back into the process area.

40. The method according to claim 39, wherein an amount of the coarse material is larger than an amount of the fines.

41. The method according to claim 35, wherein fragmenting or weakening the material comprises fragmenting or weakening rock material or ore.

42. The method according to claim 35, wherein the rinsing liquid has a lower conductivity than the process liquid which is present in the process area.

43. The method according to claim 35, wherein the conditioning of the rinsing liquid is controlled.

44. A method of fragmenting or weakening of material by high voltage discharges, comprising the steps:

a) providing a process area having a high voltage discharge gap formed between two electrodes which face each other at a distance;

b) feeding a material that is to be fragmented or weakened and a process liquid into the process area in such a way that an area between the two electrodes is filled with the material that is to be fragmented or weakened and the process liquid;

c) fragmenting or weakening the material in the process area by generating high voltage discharges between the two electrodes;

d) rinsing the material which is fed into the process area antecedent to the fragmenting or weakening with a rinsing liquid;

e) determining an electrical conductivity of the rinsing liquid; and f) changing, in dependency of the determined electrical conductivity, at least one of: feeding of the rinsing liquid or conditioning of the rinsing liquid.

45. The method according to claim 44, wherein the rinsing with the rinsing liquid takes place inside or outside of the process area.

46. The method according to claim 45, wherein the rinsing with the second rinsing liquid takes places outside of the process area and wherein between an end of the rinsing of the material with the rinsing liquid and either the feeding of the rinsed material back into the process area or charging of the material with high voltage discharges in the process area, less than 5 minutes pass.

47. The method according to claim 44, wherein the rinsing liquid is similar to the process liquid which is present in the process area during fragmenting or weakening.

48. The method according to claim 44, further comprising:

circulating the rinsing liquid in a circuit; and continuously or temporarily conditioning the rinsing liquid by at least one of: withdrawal of ions, dilution with process liquid of lower conductivity, withdrawal of fines, changing a pH-value thereof, or adding of complexing agents.

49. The method according to claim 44, wherein fragmenting or weakening the material comprises fragmenting or weakening rock material or ore.

50. The method according to claim 44, wherein the rinsing liquid has a lower conductivity than the process liquid which is present in the process area.

51. The method according to claim 44, wherein the conditioning of the rinsing liquid is controlled.

* * * * *